US007350353B2

(12) United States Patent
Ioku

(10) Patent No.: US 7,350,353 B2
(45) Date of Patent: Apr. 1, 2008

(54) HYDRAULIC CIRCUIT

(75) Inventor: Kensuke Ioku, Hyogo (JP)

(73) Assignee: Nabtesco Corporation, Tokyo (JP)

( * ) Notice: Subject to any disclaimer, the term of this patent is extended or adjusted under 35 U.S.C. 154(b) by 188 days.

(21) Appl. No.: 11/392,214

(22) Filed: Mar. 29, 2006

(65) Prior Publication Data

US 2006/0236688 A1 Oct. 26, 2006

(30) Foreign Application Priority Data

Mar. 31, 2005 (JP) ..... 2005-100744

(51) Int. Cl.
*F15B 11/00* (2006.01)
*E02F 9/22* (2006.01)

(52) U.S. Cl. ..... 60/421; 60/486

(58) Field of Classification Search ..... 60/421, 60/422, 484, 486
See application file for complete search history.

(56) References Cited

U.S. PATENT DOCUMENTS 3,720,059 A * 3/1973 Schurawski et al. ..... 60/421
4,986,072 A * 1/1991 Kubomoto ..... 60/421
5,211,014 A * 5/1993 Kropp ..... 60/421
5,692,377 A * 12/1997 Moriya et al. ..... 60/421
6,799,424 B2 * 10/2004 Ioku et al. ..... 60/486

FOREIGN PATENT DOCUMENTS

JP 10-252105 A 9/1998

OTHER PUBLICATIONS

Patent Abstracts of Japan; English Translation of Abstract of Japanese Publ. No. 10-252105; Dated Sep. 22, 1998; (2 pages).

* cited by examiner

*Primary Examiner*—Thomas E. Lazo
(74) *Attorney, Agent, or Firm*—Osha·Liang LLP

(57) ABSTRACT

To provide a hydraulic circuit with a compact and simple structure while securing the amount of a hydraulic oil necessary for right and left running motors so as to prevent the limitation of a running speed. A first system has a changing valve for a right side running motor and a changing valve for a first actuator, and a second system has a changing valve for a left side running motor and a changing valve for a second actuator. The changing valves for the right side and the left side running motors and the changing valves for the first and second actuators are tandem-connected, respectively. A merging valve has a merging position to communicate first and second supply paths with each other and interrupt supply paths for right side and left side running, a merging position to communicate the first and second supply paths with each other and communicate the supply paths for right side and left side running with each other, and a merging position to interrupt the first and second supply paths and interrupt the supply paths for right side and left side running.

8 Claims, 2 Drawing Sheets

HYDRAULIC CIRCUIT

BACKGROUND OF THE INVENTION

1. Field of the Invention

The present invention relates to a hydraulic circuit including a first system having a changing valve for a right side running motor and a changing valve for a first actuator to be connected to a first pump and a second system having a changing valve for a left side running motor and a changing valve for a second actuator to be connected to a second pump.

2. Description of the Related Art

Conventionally, as a hydraulic circuit of a construction machine, a hydraulic circuit a hydraulic circuit including a first system having a changing valve for a right side running motor and a changing valve for a first actuator to be connected to a first pump and a second system having a changing valve for a left side running motor and a changing valve for a second actuator to be connected to a second pump has been known (refer to Patent document 1). In the hydraulic circuit described in this patent document 1, a merging valve (15) for communicating and interrupting a discharge path (13*a*) of a first hydraulic pump (13) and a discharge path (14*a*) of a second hydraulic pump (14) and a changing valve (16) for selectively supplying the discharge path (13*a*) and the discharge path (14*a*) to one among a first circuit (17) and a second circuit (18), respectively.

[Patent document 1] JP-A-10-252105

However, in the hydraulic circuit configured as described in the patent document 1, when the merging valve (15) is located at an interruption position (b) and further, a changing valve (16) is located at a second position (d) in order to secure the independent state of a running system in the combined control of hydraulic motors for right and left running (5, 7) and the other actuator, hydraulic oil to be supplied from the second hydraulic pump (14) is only supplied to the hydraulic motors for right and left running (5, 7). Therefore, this involves a problem such that the amount of the hydraulic oil to be supplied to the hydraulic motors for right and left running (5, 7) runs short and a running speed is limited. In addition, since the merging valve (15) and the changing valve (16) are provided, as shown in FIG. 2 of Patent document 1, two valves are needed and this makes the hydraulic circuit larger or as shown in FIG. 3 of Patent document 1, it is necessary to provide a double structure spool and this makes the hydraulic circuit into a complex mechanism.

SUMMARY OF THE INVENTION

The present invention has been made taking the foregoing problems into consideration and provides a compact and simple hydraulic circuit that secure a necessary amount of hydraulic oil for right and left running motors so as to prevent limitation of a running speed.

The present invention relates to a hydraulic circuit including a first system having a changing valve for a right side running motor that is connected to a first pump and controls supply of the hydraulic oil to a right side running motor and a closed center type of a changing valve for a first actuator that is connected to the first pump and controls the supply of the hydraulic oil to the first actuator, and a second system having a changing valve for a left side running motor that is connected to a second pump and controls supply of the hydraulic oil to a left side running motor and a closed center type of a changing valve for a second actuator that is connected to the second pump and controls the supply of the hydraulic oil to the second actuator.

Then, the hydraulic circuit according to the present invention has the following some aspects in order to attain the above-described object. In other words, the hydraulic circuit according to the present invention is provided with the following aspect independently or appropriately being combined.

In order to attain the object, a first aspect of the invention may comprise the changing valve for the right side running motor and the changing valve for the left side running motor that are the changing valves of a center bypass type; the changing valve for the first actuator that is tandem-connected to the changing valve for the right side running motor; the changing valve for the second actuator that is tandem-connected to the changing valve for the left side running motor; a supply path for right side running for introducing the hydraulic oil from the first pump into the changing valve for the right side running motor; a supply path for the left side running for introducing the hydraulic oil from the second pump into the changing valve for the left side running motor; a first supply path for introducing the hydraulic oil from the downstream side of a center bypass path in the changing valve for the right side running motor into the changing valve for the first actuator; a second supply path for introducing the hydraulic oil from the downstream side of a center bypass path in the changing valve for the left side running motor into the changing valve for the second actuator; and a merging valve having a merging position that communicates the first supply path with the second supply path and interrupts the supply path for the right side running and the supply path for the left side running, a running direct position that communicates the first supply path with the second supply path and communicates the supply path for the right side running and the supply path for the left side running, and an interruption position that interrupts the first supply path and the second supply path and interrupts the supply path for the right side running and the supply path for the left side running.

According to this structure, when the merging valve is located at the interruption position, the hydraulic oil from the first pump is supplied to the first system and that from the second pump is supplied to the second system. In addition, when the merging valve is located at the merging position, the first supply path is connected to the second supply path, so that the hydraulic oil running short in the first actuator or the second actuator can be supplied so as to be compensated mutually in the first system and the second system. Further, when the merging valve is located at the running direct position, the hydraulic oil from both of the first and second pumps is supplied to the changing valves for the right side and left side running by priority and the hydraulic oil for the excess amount thereof is supplied to the changing valves for the first and second actuators. Furthermore, at this running direct position, the first supply path is connected to the second supply path, so that the hydraulic oil running short in the first actuator or the second actuator can be supplied so as to be compensated mutually in the first system and the second system.

Thus, according to the hydraulic circuit of the present invention, by changing the merging position into the running direct position, it is possible to supply the hydraulic oil from both of the first and second pumps in priority to the right side and left side running motors and the hydraulic oil for the excess amount thereof is supplied to the changing valves for the first and second actuators. In this case, since the hydraulic oil running short in the first actuator or the second actuator is compensated mutually in the first system and the second system, it is also possible to control delay of the actuation speed of the first or second actuators. In addition, since the merging position is provided at the merging valve, even if the supply paths for the right and left side running are interrupted, it is possible to compensate the hydraulic oil running short in the first actuator and the second actuator by the first and second systems each other and this makes it possible to control the delay of the actuation speeds of the first and second actuators.

Further, the hydraulic circuit according to the present invention may be provided with only one merging valve, so that it is possible to downsize and simplify the hydraulic circuit.

Therefore, the amount of the hydraulic oil necessary for the right and left running motors is secured so as to prevent the running speed from being limited and it is possible to provide the compact and simply configured hydraulic circuit.

In addition, a second aspect of the hydraulic circuit according to the invention may further comprise a first pressure compensation valve that is provided between the first pump and a tank and controls the pressure of the hydraulic oil supplied from the first pump; and a second pressure compensation valve that is provided between the second pump and a tank and controls the pressure of the hydraulic oil supplied from the second pump; wherein the first pressure compensation valve controls the pressure depending on the highest load pressure that is the highest pressure among the load pressures of all the actuators in the first system or the largest changing operation amount that is the largest changing operation amount among the changing operation amounts of all the changing valves in the first system; the second pressure compensation valve controls the pressure depending on the highest load pressure that is the highest pressure among the load pressures of all the actuators in the second system or the largest changing operation amount that is the largest changing operation amount among the changing operation amounts of all the changing valves in the second system; when the merging valve is changed into the merging position or the running direct position, the first pressure compensation valve and the second pressure compensation valve can control the pressure of the hydraulic oil so that this pressure coincides with the higher pressure among the pressures of the hydraulic oil controlled by the first and second compensation valves.

According to this structure, the pressure of the hydraulic oil is controlled by the first or the second pressure compensation valve so as to coincide with the pressure of the system of the higher pressure side among the first system and the second system, so that the hydraulic oil can be merged from the system at the lower pressure side to the system at the higher pressure side and this makes it possible to effectively supply the hydraulic oil from the first and second pumps to the both systems so as to improve the operating efficiency.

In addition, according to a third aspect of the hydraulic circuit according to the invention, a plurality of changing valves for the first actuator is provided in the first system and a plurality of changing valves for the second actuator is provided in the second system; and when at least one condition among three conditions, namely, a first condition that a predetermined changing valve among the changing valve for the first actuator and the changing valve for the second actuator is operated; a second condition that the changing valve for the right side running motor and the changing valve for the first actuator are operated at the same time; and a third condition that the changing valve for the left side running motor and the changing motor for the second actuator are operated at the same time is met, the merging valve is changed into the merging position.

According to this structure, when any one condition among the first to third conditions is met, the merging valve is changed to the merging position. Therefore, when the amount of the hydraulic oil runs short because the changing valve is more operated in any one system among the first and second systems, it is possible to supply the hydraulic oil from the other system.

In addition, according to a fourth aspect of the hydraulic circuit according to the invention, when the changing valve for the right side running motor and the changing valve for the left side running motor are operated at the same time and at least any one among the changing valve for the first actuator and the changing valve for the second actuator is further operated at the same time, the merging valve is changed into the running direct position.

According to this structure, the hydraulic oil from both of the first and second pumps can be supplied to the changing valves for the first and second actuators, so that it is possible to prevent the speeds of the first and second actuators from being lowered.

In addition, according to a fifth aspect of the hydraulic circuit according to the invention, an opening of each center bypass path in the changing valve for the right side running motor and the changing valve for the left side running motor is continuously changed from the state that the changing valve is located at a neutral position and is fully opened into the state that the changing valve is changed at the largest amount at the largest operation and is narrowed down at the highest degree.

According to this structure, the center bypass paths in the changing valves for the right side and left side running motors are not fully closed, so that it is always possible to supply the hydraulic oil also to the changing valves for the first and second actuators that are the changing valve for the other actuator other than the running motor.

Further, according to a sixth aspect of the hydraulic circuit according to the invention, in the merging valve, the interruption position, the merging position, and the running direct position are arranged in this order from one side; and on the basis of the amount of the hydraulic oil necessary for the operation of the right side and left side running motors or the hydraulic oil necessary for the operation of the first and second actuators, the merging valve is changed so as to return from the running direct position into the merging position.

According to this structure, when the hydraulic oil necessary for the operations of the first and second actuators is large in quantity or the hydraulic oil necessary for the operations of the right and left running motors is small in quantity, it is possible to change the merging valve from the running direct position into the merging position, and it is possible to supply the hydraulic oil to the first and second actuators by priority. Further, the amount of the hydraulic oil necessary for each of the right side and left side running motors and the first and second actuators can be detected, for example, on the basis of the changing operation amount of each changing valve.

In addition, according to a seventh aspect of the hydraulic circuit according to the invention, in the merging valve, the opening of a path to communicate the first supply path with the second supply path is continuously increased from the interruption position to the merging position.

According to this structure, since the opening of a path to communicate the first supply path with the second supply path is continuously increased till the merging valve has been changed from the interruption position into the merging position, it is possible to appropriately adjust the amount to be merged depending on the necessary amount of the hydraulic oil in the first and second systems. In addition, by appropriately adjusting the opening of the path communicating with the first and second supply paths, it is possible to supply the hydraulic oil with the allocation to be supplied to one of the first and second systems by priority.

Further, according to an eighth aspect of the hydraulic circuit according to the invention, in the merging valve, the opening of a path to communicate the supply path for the right side running with the supply path for the left side running is continuously increased from the interruption position or the merging position to the running direct position.

According to this structure, since the opening of a path to communicate the supply path for the right side running with the supply path for the left side running is continuously increased in the merging valve, it is possible to appropriately adjust the amount of the hydraulic oil to be supplied to the first and second systems depending on the necessary amount of the hydraulic oil in the first and second actuators and the right side and left side running motors. Therefore, it is possible to supply the hydraulic oil to the both systems with the hydraulic oil with the effective allocation.

DETAILED DESCRIPTION OF THE INVENTION

Description of the Preferred Embodiment(s)

Figure 1:
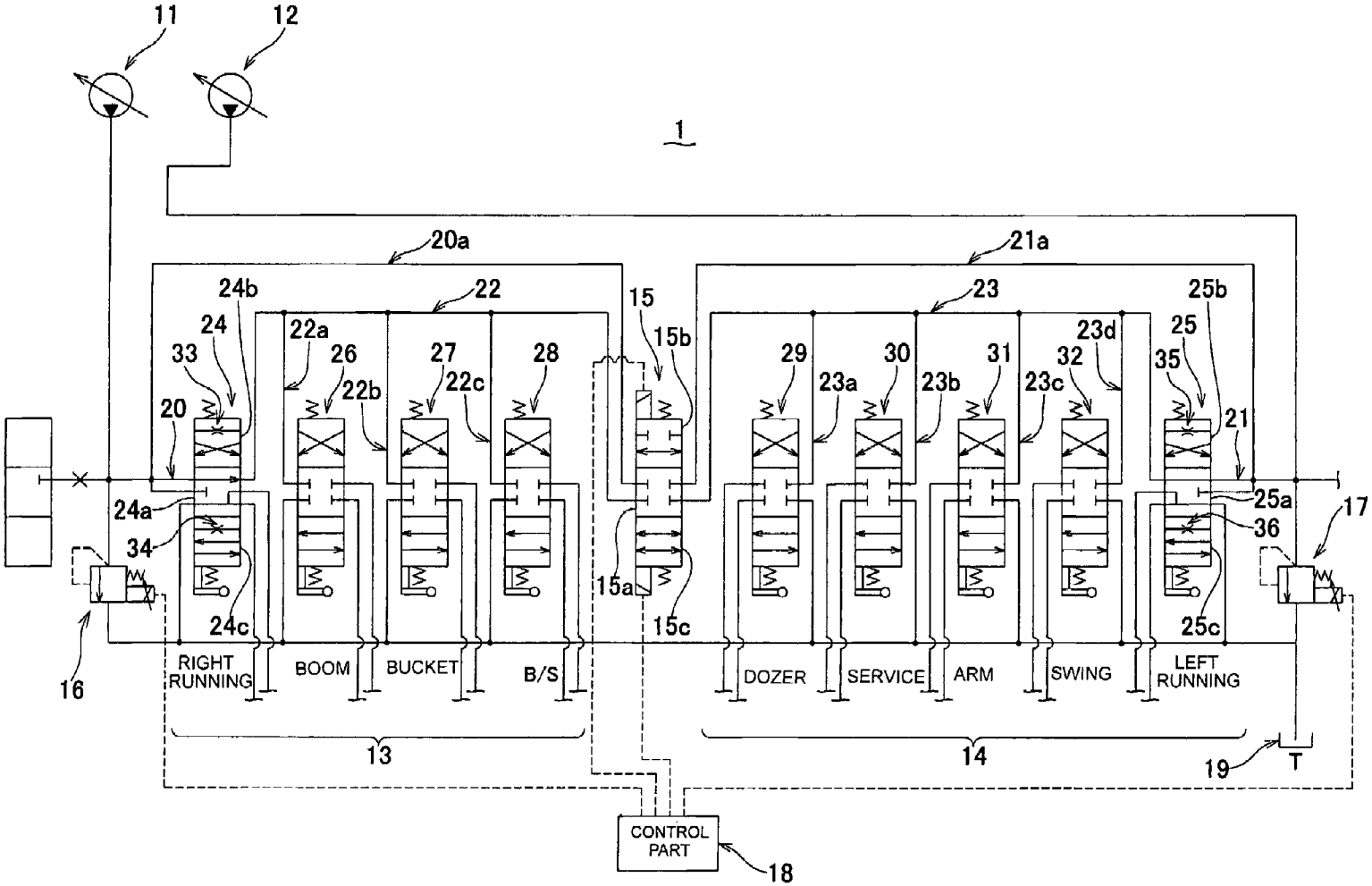
FIG. 1 is a circuit diagram illustrating a hydraulic circuit according to an embodiment of the invention.

An embodiment of the present invention will be described below with reference to the drawings. FIG. 1 illustrates a hydraulic circuit according to the embodiment of the invention, which is applied to a construction machine. The construction machine to which this hydraulic circuit 1 is applied is configured as a crawler vehicle including various driving mechanisms such as a boom and an arm. Then, this hydraulic circuit 1 is provided with each actuator such as each hydraulic motor and each cylinder to drive these respective driving mechanisms, and two hydraulic pumps such as a first pump 11 and a second pump 12 to supply the hydraulic oil for operating each actuator.

As shown in FIG. 1, the hydraulic circuit 1 is provided with each actuator (not illustrated), and a first system 13 and a second system 14 having a plurality of changing valves to control supply of the hydraulic oil to each actuator. In addition, this hydraulic circuit 1 is provided with a merging valve 15, a first pressure compensation valve 16, a second pressure compensation valve 17, a control part 18 of controlling the operations of these merging valve 15 and pressure compensation valves (16, 17), and various paths (20, 21, 22, 23) or the like.

The first system 13 is provided with a right side running motor and a first actuator that is an actuator other than the right side running motor as each actuator (not illustrated). As the first actuator, a boom cylinder for operating the boom, a bucket cylinder for operating a bucket, and a boom swing cylinder for the boom swing operation are provided.

Then, this first system 13 is provided with a changing valve for a right side running motor 24 that is a center bypass type of changing valve that is connected to the first pump 11 and controls supply of the hydraulic oil to a right side running motor and a changing valve for a first actuator that is a closed center type of changing valve that is connected to the first pump 11 and controls supply of the hydraulic oil to the first actuator. The first system 13 is provided with a plurality of the changing valves for the first actuator. Then, as this changing valves for the first actuator, a changing valve for a boom 26 to control the supply of the hydraulic oil to the boom cylinder, a changing valve for a bucket 27 to control the supply of the hydraulic oil to the bucket cylinder, and a changing valve for a boom swing 28 to control the supply of the hydraulic oil to the boom swing cylinder are provided. These respective changing valves for the first actuator (26 to 28) are tandem-connected to the changing valve for the right side running motor 24, respectively.

The changing valve for the right side running motor 24 is changed between a neutral position 24*a* (the state shown in FIG. 1) and changing positions 24*b* and 24*c* to control the supply of the hydraulic oil to the right side running motor. The opening of the center bypass path in the changing valve for the right side running motor 24 is fully opened at the neutral position 24*a*, and the center bypass path is narrowed down at changing positions 24*b* and 24*c* by apertures 33 and 34, respectively. Then, the opening of this center bypass path is formed to be continuously changed from the state that the center bypass path is fully opened at the neutral position 24*a* till the state that the changing valve 24 is changed at the highest level upon the largest operation and is narrowed down at the highest level at a changing position 24*b* or 24*c*.

The second system 14 is provided with a left side running motor and a second actuator that is an actuator other than the left side running motor as each actuator (not illustrated). As the second actuator, a dozer cylinder for operating a dozer, an actuator for a service that can be replaced as an attachment, an arm cylinder for operating the arm, and a swing motor for making swinging movement of an upper level body arranged at the upper part of a crawler.

Then, this second system 14 is provided with a changing valve for a left side running motor 25 that is a center bypass type of changing valve that is connected to the second pump 12 and controls supply of the hydraulic oil to a left side running motor and a changing valve for a second actuator that is a closed center type of changing valve that is connected to the second pump 12 and controls supply of the hydraulic oil to the second actuator. The second system 14 is provided with a plurality of the changing valves for the second actuator. Then, as this changing valves for the second actuator, a changing valve for a dozer 29 to control the supply of the hydraulic oil to the dozer cylinder, a changing valve for a service 30 to control the supply of the hydraulic oil to the actuator for service, a changing valve for an arm 31 to control supply of the hydraulic oil to the arm cylinder, and a changing valve for a swing motor 32 to control the supply of the hydraulic oil to the swing motor. These respective changing valves for the second actuator (29 to 32) are tandem-connected to the changing valve for the left side running motor 25, respectively.

Further, the changing valve for the left side running motor 25 is changed between a neutral position 25*a* (the state shown in FIG. 1) and changing positions 25*b* and 25*c* so as to control supply of the hydraulic oil to the left side running motor. The opening of the center bypass path in the changing valve for the left side running motor 25 is full opening at the neutral position 25*a* and the center bypass path is narrowed at changing positions 25*b* and 25*c* by apertures 35 and 36, respectively. The opening of this center bypass path is formed to be continuously changed from the state that the center bypass path is fully opened at the neutral position 25*a* till the state that the changing valve 25 is changed at the highest level upon the largest operation and is narrowed down at the highest level at the changing position 25*b* or 25*c*.

In addition, as the above-described various paths, the hydraulic circuit 1 is provided with a supply path for a right side running 20, a supply path for a left side running 21, a first supply path 22, and a second supply path 23 or the like. The supply path for the right side running 20 is disposed so as to introduce the hydraulic oil from the first pump 11 into the changing valve for the right side running motor 24. The supply path for the left side running 21 is disposed so as to introduce the hydraulic oil from the second pump 12 into the left side running motor 25. Further, the supply path for the right side running 20 is connected to the merging valve 15 via a communication path 20*a* and the supply path for the left side running 21 is connected to the merging valve 15 via a communication path 21*a*.

The first supply path 22 is disposed so as to introduce the hydraulic oil from the downstream side of the center bypass path in the changing valve for the right side running motor 24 into respective changing valves for the first actuator (26 to 28). In other words, the first supply path 22 connects the downstream side of the changing valve for the right side running motor 24 to each changing valve (26, 27, 28), respectively, via each parallel path (22*a*, 22*b*, 22*c*). Thereby, each changing valve (26, 27, 28) is tandem-connected to the changing valve for the right side running motor 24. In addition, the lowest downstream side of the first supply path 22 is connected to the merging valve 15.

The second supply path 23 is disposed so as to introduce the hydraulic oil from the downstream side of the center bypass path in the changing valve for the left side running motor 25 into respective changing valves for the second actuator (29 to 32). In other words, the second supply path 23 connects the downstream side of the changing valve for the left side running motor 25 to each changing valve (29, 30, 31, 32), respectively, via each parallel path (23*a*, 23*b*, 23*c*, 23*d*). Thereby, each changing valve (29, 30, 31, 32) is tandem-connected to the changing valve for the left side running motor 25. In addition, the lowest downstream side of the second supply path 23 is connected to the merging valve 15.

The merging valve 15 is provided as an electrode changing valve that is changed by changing the excitation state and the degaussing state on the basis of the control command from the control part 18. The merging valve 15 is changed between an interruption position 15*a*, a merging position 15*b*, and a running direct position 15*c*. At the interruption position 15*a* (the state shown in FIG. 1), the first supply path 22 and the second supply path 23 are interrupted. Then, at this interruption position 15*a*, the supply path for the right side running 20 and the supply path for the left side running 21 are further interrupted by interrupting the communication path 20*a* and the communication path 21*a*. On the other hand, at the merging position 15*b* changed from this merging position 15*a*, the first supply path 22 is communicated with the second supply path 23, and the supply path for the right side running 20 and the supply path for the left side running 21 are interrupted (the communication path 20*a* and the communication path 21*a* are interrupted). In addition, at the running direct position 15*c* changed from the neutral position 15*a*, the first supply path 22 is communicated with the second supply path 23 and the communication path 20*a* and the communication path 21*a* are connected each other, and thereby, the supply path for the right side running 20 is communicated with the supply path for the left side running 21. Further, the merging valve 15 is formed so that the opening of the path communicating the first supply path 22 with the second supply path 23 is continuously increased from the interruption position 15*a* to the merging position 15*b*.

The first pressure compensation valve 16 is arranged between the first pump 11 and a tank 19, and the first pressure compensation valve 16 is disposed as a proportional solenoid valve to adjust the opening of the path between the first pump 11 and the tank 19. Thereby, the first pressure compensation valve 16 controls the pressure of the hydraulic oil supplied from the first pump 11 on the basis of the control command from the control part 18. In addition, the second pressure compensation valve 17 is arranged between the second pump 12 and the tank 19 and the second pressure compensation valve 17 is disposed as a proportional solenoid valve to adjust the opening of the path between the second pump 12 and the tank 19. Thereby, the second pressure compensation valve 17 controls the pressure of the hydraulic oil supplied from the second pump 12 on the basis of the control command from the control part 18.

The control part 18 is configured to be provided with a CPU (Central Processing Unit), a memory (a ROM (Read Only Memory)), a RAM (Random Access Memory), and a current control circuit or the like. Then, this control part 18 is connected to each coil part of the merging valve 15, the first pressure compensation valve 16, and the second pressure compensation valve 17 so as to energize and excite them. Further, the control part 18 can change these respective valves (15 to 17) by controlling the operations of the merging valve 15, the first pressure compensation valve 16, and the second pressure compensation valve 17. In addition, respective changing valves (24, 26 to 28) of the first system 13 and respective changing valves (25, 29 to 32) of the second system 14 are provided with changing amount detection sensors (not illustrated) to detect each changing amount of each changing valve, and the detection result of each of these changing amount detection sensors is inputted in the control part 18. In addition, pressure pickups (not illustrated) to detect the pressure of the hydraulic oil are provided at the upstream sides of the first pressure compensation valve 16 and the second pressure compensation valve 17, and the detection result of each pressure pickup is also inputted in the control part 18.

The control part 18 outputs the control command depending on the largest changing amount that is the largest changing amount in the changing operational amounts of all the changing valves (24, 26 to 28) of the first system 13 to the first pressure compensation valve 16 on the basis of the detection results of changing operational amount detection sensors of respective changing valves (24, 26 to 28) in the first system 13. The first pressure compensation valve 16 controls the pressure of the hydraulic oil supplied from the first pump 11 depending on the largest changing amount when it is operated on the basis of the control command from the control part 18.

The control part 18 outputs the control command depending on the largest changing amount that is the largest changing amount in the changing operational amounts of all the changing valves (25, 29 to 32) of the second system 14 to the second pressure compensation valve 17 on the basis of the detection results of changing operational amount detection sensors of respective changing valves (25, 29 to 32) in the second system 14. The second pressure compensation valve 17 controls the pressure of the hydraulic oil supplied from the second pump 12 depending on the largest changing amount when it is operated on the basis of the control command from the control part 18.

Further, the control 18 serves to control the operations of the first pressure compensation valve 16 and the second pressure compensation valve 17 on the basis of the detection result of the pressure pickup to detect the pressure at the upstream sides of the first pressure compensation valve 16 and the second pressure compensation valve 17. In other words, the control part 18 compares the detection results of the above-described both pressure pickups when the merging valve 15 is changed into the merging position 15*b* or the running direct position 15*c* and outputs a control command to the first pressure compensation valve 16 or the second pressure compensation valve 17 that controls the lower pressure so as to conform this lower pressure to the higher pressure among the pressures of the hydraulic oil controlled by each of the first and second pressure compensation valves (16, 17). When the first pressure compensation valve 16 or the second pressure compensation valve 17 is operated on the basis of this control command, the first and second pressure compensation valves (16, 17) are controlled being unified to the higher pressure amount the pressures of the hydraulic oil controlled by the first and second pressure compensation valves (16, 17), respectively.

In addition, the control part 18 controls the operation of the merging valve 15 so that the merging valve 15 is changed to the merging position 15*b* when at least one condition of predetermined three conditions (first to third conditions) determined on the basis of the detection result at the changing amount detection sensors of respective changing valves (24 to 32) in the first system 13 and the second system 14 is met. In this case, as a first condition that is necessarily met in order to change the merging valve 15 into the merging position 15*b*, the condition that a predetermined changing valve among the changing valves for the first actuator (26 to 28) and the changing valve among the changing valves for the second actuator (29 to 32) is operated is determined. The operation of the predetermined changing valve includes the sole control of the changing valve for the boom 26; the sole control of the changing valve for the arm 31; the sole control of the changing valve for the bucket 27; the sole control of the changing valve for the service 30; the combined control of the changing valve for the boom 26 and the changing valve for the bucket 27; the combined control of the changing valve for the boom 26 and the changing valve for the service 30; the combined control of the changing valve for the arm 31 and the changing valve for the bucket 27; or the combined control of the changing valve for the boom 26, the changing valve for the arm 31, and the changing valve for the bucket 27 or the like. In addition, as a second condition, the changing valve for the right side running motor 24 and at least one changing valve among the changing valves for the first actuator (26 to 28) are simultaneously operated is determined. In addition, as a third condition, the condition that the changing valve for the left side running motor 25 and at least one changing valve among the changing valves for the second actuator (29 to 32) are simultaneously operated is determined.

In addition, the control part 18 may control the operation of the merging valve 15 so that the merging valve 15 is changed to the running direct position 15*c* when the changing valve for the right side running motor 24 and the changing valve for the left side running motor 25 are simultaneously operated and at least any one among the changing valves for the first actuator (26 to 28) and the changing valves for the second actuator (29 to 32) is also operated on the basis of the detection result of the changing amount detection sensors of the changing valve for the right side running motor 24 and the changing valve for the left side running motor 25.

Next, the operation of the hydraulic circuit 1 when the above-described changing operation control of the merging valve 15 due to the control part 18 is carried out will be described. At first, when the merging valve 15 is located at the interruption position 15*a*, the hydraulic oil is supplied to the first system 13 from the first pump 11, and then, the hydraulic oil is supplied to the second system 14 from the second pump 12. If the control part 18 is notified of that at least one condition among the above-described first to third conditions is met, the merging valve 15 will be changed into the merging position 15*b* according to the control command from the control part 18. If the merging valve 15 is changed into the merging position 15*b*, the first supply path 22 and the second supply path 23 will be connected each other with the supply path for the right side running 20 and the supply path for the left side running 21 interrupted. Therefore, the hydraulic oil from the downstream side of the changing valve for the right side running motor 24 to be supplied to the changing valves for the first actuator (26 to 28) and the hydraulic oil from the downstream side of the changing valve for the left side running motor 25 to be supplied to the changing valves for the second actuator (29 to 32) are supplied so as to be compensated each other. In other words, the hydraulic oil running short in the first and second actuators can be supplied so as to be compensated in the first system 13 and the second system 14 each other.

In addition, if the control part 18 is notified of that the state that the merging valve 15 is located at the interruption position 15*a* or the merging position 15*b* into the state that the changing valve for the right side running motor 24 and the changing valve for the left side running motor 25 are operated at the same time and at least any of the changing valves for the first actuator (26 to 28) and the changing valves for the second actuator (29 to 32) are further operated at the same time, the merging valve 15 will be changed into the running direct position 15*c* according to the control command from the control part 18. If the merging valve 15 is changed into the running direct position 15*c*, the communication path 20*a* and the communication path 21*a* are connected each other and this leads to that the supply path for the right side running 20 at the upstream of the changing valve for the right side running motor 24 and the supply path for the left side running 21 at the downstream of the changing valve for the left side running motor 25 are communicated with each other. Then, further, the first supply path 22 at the downstream side of the changing valve for the right side running motor 24 and the second supply path 23 at the downstream side of the changing valve for the left side running motor 25 will be connected each other.

Thus, since the supply path for the right side running 20 and the supply path for the left side running 21 are communicated with each other, the hydraulic oil from the both of the first pump 11 and the second pump 12 is supplied to the changing valve for the right side running motor 24 and the changing valve for the left side running motor 25 by priority. Then, the hydraulic oil of this excess amount is supplied to the changing valves for the first actuator (26 to 28) through the first supply path 22 and is supplied to the changing valves for the second actuator (29 to 32) through the second supply path 23. Further, since the first supply path 22 and the second supply path 23 are connected each other, the hydraulic oil running short in the first actuator or the second actuator can be supplied so as to be compensated each other in the first system 13 and the second system 14.

As described above, in the hydraulic circuit 1 according to the present embodiment, by changing the merging valve 15 into the running direct position 15*c*, the hydraulic oil from the both of the first and second pumps (11, 12) can be supplied to the changing valves for the right side and the left side running motors (24, 25) by priority, and this excess amount can be supplied to the changing valves for the first and second actuators (26 to 32). In this case, since the hydraulic oil running short in the first actuator or the second actuator can be supplied so as to be compensated each other in the first system 13 and the second system 14, it is possible to prevent the operational speed of the first or the second actuator from being lowered. In addition, since the merging valve 15 is provided with the merging position 15*b*, even if the supply path for the right side running and for the left side running (20, 21) are interrupted, the hydraulic oil running short in the first or the second actuator can be compensated each other in the first system 13 and the second system 14 and it is possible to prevent the operational speed of the first and second actuators from being lowered. In addition, the hydraulic circuit 1 may be provided with only one merging valve 15 and it is possible to downsize and simplify the hydraulic circuit. Accordingly, it is possible to provide a hydraulic circuit with a compact and simple structure while securing a necessary amount of the hydraulic oil that is necessary for the right and left running motors so as to prevent limitation of a running speed.

In addition, according to the hydraulic circuit 1, the pressure in the first system 13 and the second system 14 is controlled by the first or the second pressure compensation valve (16, 17) so as to coincide with the pressure of the system at the higher pressure side, so that the hydraulic oil can be merged from the system at the lower pressure side to the system at the higher pressure side, and this makes it possible to improve the operating efficiency by effectively supplying the hydraulic oil from the first and second pumps (11, 12).

In addition, according to the hydraulic circuit 1, when any one condition among the first to third conditions is met, the merging valve 15 is changed into the merging position 15*b*, so that it is possible to supply the hydraulic oil from the other system by operating the changing valves much in one system among the first and the second systems (13, 14) when the amount of the hydraulic oil runs short.

Further, according to the hydraulic circuit 1, when the merging valve 15 is located at the running direct position 15*c*, it is possible to supply the hydraulic oil to the changing valves for the first and second actuators (26 to 32) from both of the first and second pumps (11, 12) and it is possible to prevent the speeds of the first and second actuators from being lowered.

Further, according to the hydraulic circuit 1, since the center bypass paths in the changing valves for the right side and left side running motors (24, 25) are not fully opened, it is also possible to always supply the hydraulic oil to the changing valves for the first and second actuators (26 to 32) as the changing valve of the other actuator other than the running motor.

In addition, according to the hydraulic circuit 1, since the opening of the path to communicate the first and second supply paths (22, 23) with each other is continuously increased till the merging valve 15 is changed from the interruption position 15*a* into the merging position 15*b*, it is possible to appropriately adjust the amount to be merged depending on the amount of the necessary hydraulic oil in the first system 13 and the second system 14. In addition, by appropriately adjusting the opening of the path to communicate the first and second supply paths (22, 23), the hydraulic oil can be supplied to one of the first and second systems (13, 14) by priority.

The embodiment of the present invention is as described above, however, the present invention is not limited to the above-described embodiment but various modifications are possible within a scope of the claims. For example, it is also possible to provide a hydraulic circuit according to the other embodiment described below.

(1) The present embodiment is described by taking the case that the first pressure compensation valve 16 controls the pressure depending on the largest changing amount that is the larges changing operational amount among the changing operation amounts of all the changing valves (24, 26 to 28) in the first system 13 according to the control command from the control part 18 as an example, however, it is no need that the present invention is always as it is. The first pressure compensation valve 16 may control the pressure of the hydraulic oil to be supplied from the first pump 11 depending on the highest load pressure that is the highest pressure among the load pressures in all the actuators (the running motor at the right side, the first actuator) in the first system 13 on the basis of the control command from the control part 18.

In addition, the second pressure compensation valve 17 may control as same as the above. In other words, the second pressure compensation valve 17 may control the pressure of the hydraulic oil to be supplied from the second pump 12 depending on the highest load pressure that is the highest pressure among the load pressures in all the actuators (the running motor at the left side, the second actuator) in the second system 14 on the basis of the control command from the control part 18. In the case of this other embodiment, for example, each of all the actuators (the right and left running motors, the first and second actuators) is provided with a pressure pickup to detect the pressure of the hydraulic oil so as to input the detection result of this each pressure pickup in the control part 18. Thereby, the above-described control can be made by the first pressure compensation valve 16 and the second pressure compensation valve 17 according to the control command from the control part 18.

Figure 2:
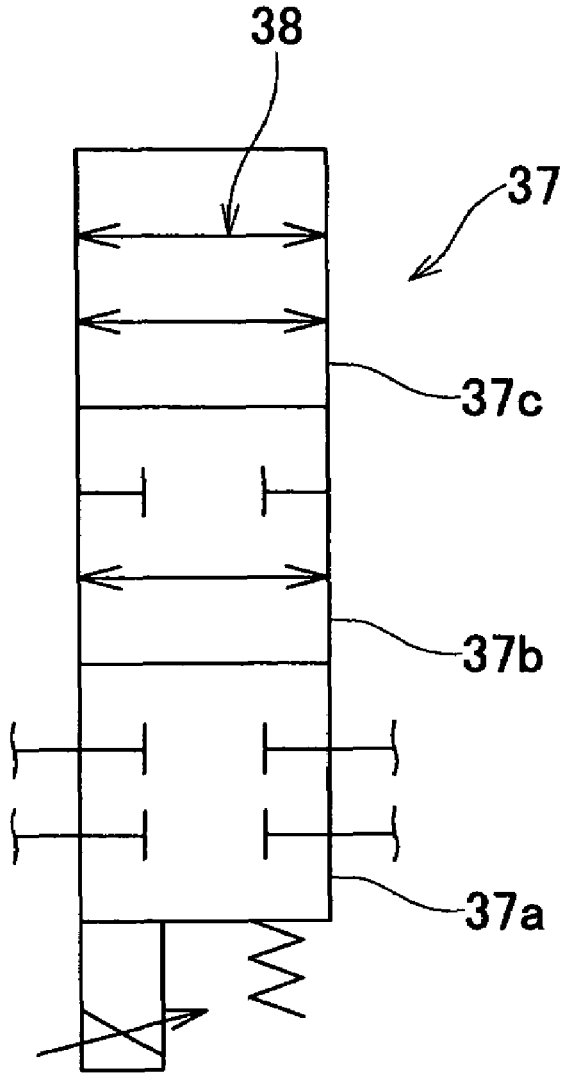
FIG. 2 is a circuit diagram showing a merging valve in a hydraulic circuit according to the other embodiment of the invention.

(2) It is also possible to provide a hydraulic circuit including a merging valve 37 as shown in FIG. 2 in place of the merging valve 15. In other words, the merging valve 37 may be available, in which an interruption position 37*a* to interrupt the supply paths for the right side running and the left side running (20, 21) and interrupt the first and second supply paths (22, 23) from one side, a merging position 37*b* to interrupt the supply paths for the right side running and the left side running (20, 21) and communicate the first and second supply paths (22, 23) with each other, and a running direct position 37*c* to communicate the supply paths for the right side running and the left side running (20, 21) and communicate the first and second supply paths (22, 23) with each other are arranged in this order. Then, the control part 18 may control the merging valve 37 so as to be changed from the running direct position 37*c* into the merging position 37*b* on the basis of the amount of the hydraulic oil necessary for the operations of the right side and left side running motors or the amount of the hydraulic oil necessary for the operations of the first actuator and the second actuator. In this case, the amounts of the hydraulic oil necessary for the right side and left side running motors and the first and second actuators respectively can be detected according to the detecting result of the changing operational amount detection sensor of each changing valve.

According to the above-described structure, when the amount of the hydraulic oil necessary for the first and second actuators is large, or when the amount of the hydraulic oil necessary for the right side and left side running motors is small, it is possible to change the merging valve 37 from the running direct position 37*c* into the merging position 37*b* and it is possible to supply the hydraulic oil to the first and second actuators by priority.

In addition, the merging valve 37 shown in FIG. 2 is formed so that the opening of the path 38 to communicate the supply path for the right side running 20 and the supply path for the left side running 21 with each other is continuously increased from the interruption position 37*a* or the merging position 37*b* to the running direct position 37*c*. Thus, according to the hydraulic circuit of the other embodiment including the merging valve 37, since the opening of the path 38 is continuously increased, it is possible to appropriately adjust the amount of the hydraulic oil to be supplied to the first and second systems (13, 14) depending on the amount of the hydraulic oil necessary for the first and second actuators and the right side and left side running motors. As a result, it is possible to effectively allocate and supply the hydraulic oil to the both systems.

(3) In place of the changing operational amount detection sensor, the operational amount of the lever may be detected. Further, in the case of using a remote control such as an electric joy stick, this output can be used for the detection signal.

(4) When coinciding the pressures of the first and second pressure compensation valves (16, 17) with the higher one, the control command to the pressure compensation valve with the higher pressure may be sent to the pressure compensation valve with the lower pressure.

What is claimed is:

1. A hydraulic circuit including a first system having a changing valve for a right side running motor that is connected to a first pump and controls supply of a hydraulic oil to the right side running motor, and a changing valve for a first actuator of a closed center type that is connected to the first pump and controls supply of the hydraulic oil to the first actuator; and a second system having a changing valve for a left side running motor that is connected to a second pump and controls supply of a hydraulic oil to the left side running motor, and a changing valve for a second actuator of a closed center type that is connected to the second pump and controls supply of the hydraulic oil to the second actuator; comprising:

the changing valve for the right side running motor and the changing valve for the left side running motor that are the changing valves of a center bypass type; the changing valve for the first actuator that is tandem-connected to the changing valve for the right side running motor;

the changing valve for the second actuator that is tandem-connected to the changing valve for the left side running motor;

a supply path for right side running for introducing the hydraulic oil from the first pump into the changing valve for the right side running motor;

a supply path for the left side running for introducing the hydraulic oil from the second pump into the changing valve for the left side running motor;

a first supply path for introducing the hydraulic oil from the downstream side of a center bypass path in the changing valve for the right side running motor into the changing valve for the first actuator;

a second supply path for introducing the hydraulic oil from the downstream side of a center bypass path in the changing valve for the left side running motor into the changing valve for the second actuator;

and a merging valve having a merging position that communicates the first supply path with the second supply path and interrupts the supply path for the right side running and the supply path for the left side running, a running direct position that communicates the first supply path with the second supply path and communicates the supply path for the right side running and the supply path for the left side running, and an interruption position that interrupts the first supply path and the second supply path and interrupts the supply path for the right side running and the supply path for the left side running.

2. The hydraulic circuit according to claim 1, further comprising:

a first pressure compensation valve that is provided between the first pump and a tank and controls the pressure of the hydraulic oil supplied from the first pump; and a second pressure compensation valve that is provided between the second pump and a tank and controls the pressure of the hydraulic oil supplied from the second pump;

wherein the first pressure compensation valve controls the pressure depending on the highest load pressure that is the highest pressure among the load pressures of all the actuators in the first system or the largest changing operation amount that is the largest changing operation amount among the changing operation amounts of all the changing valves in the first system;

the second pressure compensation valve controls the pressure depending on the highest load pressure that is the highest pressure among the load pressures of all the actuators in the second system or the largest changing operation amount that is the largest changing operation amount among the changing operation amounts of all the changing valves in the second system;

when the merging valve is changed into the merging position or the running direct position, the first pressure compensation valve and the second pressure compensation valve can control the pressure of the hydraulic oil so that this pressure coincides with the higher pressure among the pressures of the hydraulic oil controlled by the first and second compensation valves.

3. The hydraulic circuit according to claim 1, wherein a plurality of changing valves for the first actuator is provided in the first system and a plurality of changing valves for the second actuator is provided in the second system; and when at least one condition among three conditions, namely, a first condition that a predetermined changing valve which is either the changing valve for the first actuator or the changing valve for the second actuator is operated; a second condition that the changing valve for the right side running motor and the changing valve for the first actuator are operated at the same time; and a third condition that the changing valve for the left side running motor and the changing motor for the second actuator are operated at the same time is met, the merging valve is changed into the merging position.

4. The hydraulic circuit according to claim 1, wherein, when the changing valve for the right side running motor and the changing valve for the left side running motor are operated at the same time and at least any one among the changing valve for the first actuator and the changing valve for the second actuator is further operated at the same time, the merging valve is changed into the running direct position.

5. The hydraulic circuit according to claim 1, wherein an opening of each center bypass path in the changing valve for the right side running motor and the changing valve for the left side is continuously changed from the state that the changing valve is located at a neutral position and is fully opened into the state that the changing valve is changed at the largest amount at the largest operation and is narrowed down at the highest degree.

6. The hydraulic circuit according to claim 1, wherein, in the merging valve, the interruption position, the merging position, and the running direct position are arranged in this order from one side; and on the basis of the amount of the hydraulic oil necessary for the operation of the right side and left side running motors or the hydraulic oil necessary for the operation of the first and second actuators, the merging valve is changed so as to return from the running direct position into the merging position.

7. The hydraulic circuit according to claim 1, wherein, in the merging valve, the opening of a path to communicate the first supply path with the second supply path is continuously increased from the interruption position to the merging position.

8. The hydraulic circuit according to claim 1, wherein, in the merging valve, the opening of a path to communicate the supply path for the right side running with the supply path for the left side running is continuously increased from the interruption position or the merging position to the running direct position.

* * * * *